US007985797B2

(12) United States Patent
Kitagawa et al.

(10) Patent No.: US 7,985,797 B2
(45) Date of Patent: Jul. 26, 2011

(54) AQUEOUS TEXTILE PRINTING COMPOSITION AND CONTINUOUS TEXTILE PRINTING METHOD OF AQUEOUS TEXTILE PRINTING COMPOSITION

(75) Inventors: Yosuke Kitagawa, Kyoto (JP); Osamu Sasaki, Kyoto (JP); Masaki Kariya, Kyoto (JP)

(73) Assignee: Matsui Shikiso Chemical Co., Ltd., Kyoto-shi, Kyoto (JP)

( * ) Notice: Subject to any disclaimer, the term of this patent is extended or adjusted under 35 U.S.C. 154(b) by 1132 days.

(21) Appl. No.: 11/737,226

(22) Filed: Apr. 19, 2007

(65) Prior Publication Data

US 2008/0044582 A1 Feb. 21, 2008

(30) Foreign Application Priority Data

Aug. 17, 2006 (JP) ..... 2006-222360

(51) Int. Cl.

| | |
|---|---|
| ***C08L 75/00*** | (2006.01) |
| ***C08K 3/22*** | (2006.01) |
| ***C08K 3/24*** | (2006.01) |
| ***D06M 15/00*** | (2006.01) |

(52) U.S. Cl. ..... 524/591; 524/431; 524/442; 524/804; 524/806; 528/422; 252/8.61

(58) Field of Classification Search ..... 524/591, 524/804, 806; 252/8.61
See application file for complete search history.

(56) References Cited

U.S. PATENT DOCUMENTS

| | | | | |
|---|---|---|---|---|
| 3,494,878 | A * | 2/1970 | Haag et al. | 427/388.4 |
| 3,756,992 | A * | 9/1973 | Dieterich | 524/591 |
| 3,766,116 | A * | 10/1973 | Olhoft | 524/377 |
| 4,606,268 | A | 8/1986 | Jaffa | 101/115 |
| 5,770,651 | A * | 6/1998 | Traubel et al. | 524/591 |
| 5,932,652 | A * | 8/1999 | Roesler et al. | 524/839 |
| 2003/0118786 | A1 | 6/2003 | Li et al. | 428/195 |
| 2005/0131135 | A1* | 6/2005 | Roesler et al. | 524/589 |
| 2009/0304925 | A1* | 12/2009 | Berge et al. | 427/256 |

FOREIGN PATENT DOCUMENTS

| | | | |
|---|---|---|---|
| EP | 0 480 162 | A1 | 8/1991 |
| JP | 55120675 | * | 9/1980 |
| JP | 55120675 | A * | 9/1980 |
| JP | 07157622 | | 6/1995 |
| JP | 10337945 | | 12/1998 |
| JP | 2004084149 | | 3/2004 |
| JP | 2006082255 | | 3/2006 |

* cited by examiner

*Primary Examiner* — Tae H Yoon
(74) *Attorney, Agent, or Firm* — Licata & Tyrrell P.C.

(57) ABSTRACT

An aqueous textile printing composition is provided having superior printing characteristics that can be used with multicolor rotating screen printing machines without causing environmental problems.

1 Claim, No Drawings

AQUEOUS TEXTILE PRINTING COMPOSITION AND CONTINUOUS TEXTILE PRINTING METHOD OF AQUEOUS TEXTILE PRINTING COMPOSITION

This patent application claims the benefit of priority from Japanese Patent Application No. 2006-222360, filed Aug. 17, 2006, teachings of which are herein incorporated by reference in their entirety.

TECHNICAL FIELD

The present invention relates to an aqueous textile printing composition and a continuous textile printing method of the aqueous textile printing composition.

BACKGROUND ART

A method for printing characters and designs onto a base material such as fabrics includes pigment textile printing methods.

In pigment textile printing methods, a textile printing agent consisting of a coloring pigment and a binder resin is printed on a base material, then the base material is heated, dried and cured to fix the printing agent on it.

The printing methods include a silk screen method wherein a pattern of a screen mesh extended on a screen holder is continuously printed, and a rotary screen method wherein a pattern of a cylindrical metallic screen mesh is continuously printed. As a screen printing machine used for these printing methods, there are a long hand-screen printing machine to print on lengthy materials, a running-type or belt-conveyer-type automatic screen printing machine, a rotary screen printing machine and others.

Meanwhile, as a printing machine used for printing cut fabrics and sewing products such as T shirts, there are a T-shirt textile printing table wherein a material is placed on a printing table so that it is printed by a hand screen; a rotating (turntable-type) automatic printing machine wherein stages consisting of a screen onto which a screen mesh is extended and a dryer are placed radial to the center of a turntable at its circumference, and wherein multicolor screen printing is enabled by intermittently rotating and revolving a pallet (printing table); and an elliptical multi-station screen textile printing machine wherein stages consisting of a screen onto which a screen mesh is extended, a dryer and a cooling machine are placed in an elliptical shape, and wherein multicolor screen printing is enabled by rotating and revolving a pallet (printing table).

Items related to the pigment textile printing methods include, for example, (a) a printing method on a polyurethane foam as a material to be printed, wherein a soft polyurethane resin paint as a ground coating agent is coated on the material to be printed with a coating amount of 25-100 g/m$^2$ to form a cover of ground, which is either naturally dried or dried/solidified by heating, and one or more screen printing plates corresponding to the number of colors for characters and design to be multicolor-printed are placed on said material having said cover of ground, then plastisol inks with respective colors are printed on said material, which are then sequentially naturally dried or dried/solidified by heating (Patent document 1), (b) a fabric having a photoluminescent pattern, wherein on the surface of the dyed and finished fabric, desired characters and patterns are printed using coloring pastes having a pigment, a binder resin, metallic powder and/or glass beads as major components (Patent document 2), (c) a printed material having a suede-like surface consisting of a ground layer [2] printed on a base material[1] using an undercoating ink, a middle layer[3] formed by recoating said ground layer with a plastisol ink containing a vinyl chloride resin, and an overcoating layer[4] formed by recoating said middle layer with a plastisol ink containing a foaming agent and a vinyl chloride resin (Patent document 3).

[Patent document 1] JP, A, 10-337945

[Patent document 2] JP, A, 2004-84149

[Patent document 3] JP, A, 2006-82255

In the above examples, multicolor rotating screen printing machines are not used.

A multicolor rotating screen printing machine uses a plastisol ink consisting of a vinyl chloride resin and a plasticizer to print on base materials such as a fabric, wherein after screen printing on the base material such as a fabric, said ink is semi-gelatinized by, for example, far-infrared radiation for 6-10 s using a far-infrared dryer, and thus no tack develops on the printed surface even under heating conditions; accordingly, even if the printed surface is pressed during printing of the next screen, continuous printing is possible without blocking the back surface of the next screen.

In addition, in the case of printing on a colored fabric, after a white plastisol ink is printed on the entire design of the colored fabric as a hiding layer and is irradiation-dried using a far-infrared dryer, said plastisol ink enables wet-on-wet printing of a colored ink.

This is considered to be possible because a large amount of plasticizer is contained in the plastisol ink, the plasticizer bleeds on the printed surface to suppress the blocking of the back surface of the next screen.

Furthermore, the plastisol ink does not dry under normal temperature, preventing the clogging during continuous printing; thus, the plastisol ink is considered to be a suitable ink for multicolor rotating screen printing machines.

However, with respect to plastisol inks consisting of a vinyl chloride resin and a plasticizer, an environment-related problem has been pointed out; in addition, there are problems of defects in terms of quality of printed materials, including heavy weight of printed parts, no breathability, hardening/shrinking and cracking due to elution of the plasticizer by washing.

Regarding this environmental problem, an acrylic plastisol ink has been developed recently (Patent document 4).

However, in this developed ink, only the vinyl chloride resin is replaced with an acrylic resin, and the plasticizer is still contained; therefore, the environmental problem has not yet been solved. Moreover, preservation stability of the ink is deteriorated due to high swellability of acrylic resins to plasticizers. Furthermore, regarding the quality of textile printed materials, the defects of vinyl chloride plastisol inks such as no breathability, hardening/shrinking and cracking due to elution of the plasticizer by washing have not yet been solved.

[Patent document 4] JP, A, 07-157622

Under the above-mentioned circumstances, the development of an aqueous printing composition having superior printing characteristics, which does not cause environmental problems and which enables the use of multicolor rotating screen printing machines has been awaited.

DISCLOSURE OF THE INVENTION

Problem to be Solved by the Invention

The object of the invention is to provide an aqueous printing composition having superior printing characteristics, which does not cause environmental problems and which enables the use of multicolor rotating screen printing machines.

Means of Solving the Problem

We devoted ourselves to the research to solve the above problems, and found that the use of a special resin as a binder resin of aqueous textile printing compositions may prevent tack on a printed surface, resulting in non-occurrence of blocking on the back of the next screen, and thus enables continuous printing; and found that accordingly an aqueous textile printing composition for multicolor rotating screen printing machines could be obtained. We completed the present invention after further research.

The present invention consists of the following individual inventions.

1. An aqueous tack-prevention textile printing composition for multicolor rotating screen printing machines, wherein one or more resins from the group consisting of saturated polyester resin, polyamide resin, polyethylene resin, polyurethane resin, ethylene vinyl ester copolymer resin, silicone resin and acrylic silicone copolymer resin, which are tack prevention components, are used as a binder resin.
2. The aqueous tack-prevention textile printing composition for multicolor rotating screen printing machines according to the above 1, wherein the saturated polyester resin, polyamide resin, polyethylene resin, polyurethane resin, ethylene vinyl ester copolymer resin, silicone resin and acrylic silicone copolymer resin are those having a glass transition point (Tg) between −40 and 30° C.
3. A continuous textile printing method, wherein after printing of an aqueous white-ground textile printing composition, printing of an aqueous tack-prevention textile printing composition is performed, and then printing of an aqueous color textile printing composition is performed, wherein the textile printing composition according to the above 1 or 2 is used as the aqueous tack-prevention textile printing composition.
4. The continuous textile printing method according to the above 3, wherein the aqueous white-ground textile printing composition, the aqueous tack-prevention textile printing composition, or the aqueous color textile printing composition contains a hydrophilic solvent having a boiling point higher than that of water, and/or urea, which are a water-evaporation suppression component.
5. The continuous textile printing method according to the above 4, wherein the hydrophilic solvent having a boiling point higher than that of water is a polyvalent alcohol.
6. The aqueous tack-prevention textile printing composition for multicolor rotating screen printing machines according to the above 1 or 2, or the continuous textile printing method according to the above 3, 4 or 5, wherein the aqueous tack-prevention textile printing composition contains an inorganic porous material which is a surface-staining-power enhancement component.
7. The continuous textile printing method according to the above 3, 4 or 5, wherein the aqueous color textile printing composition contains an oil which is an adhesion-prevention component to the back of screens, and a nonionic surfactant having a cloud point between 30 and 90° C.
8. A fabric or clothing produced by the continuous textile printing method according to the above 3, 4, 5, 6 or 7.

The present invention is based on the following findings.

(1) Problem in Continuous Textile Printing

Conventionally, when color textile printing compositions are to be printed on a colored fabric, at first a white textile printing composition is printed on the colored fabric to form a hiding layer, then color textile printing compositions are printed on the hiding layer.

When this printing process is performed continuously, the adoption of an aqueous textile printing agent using an environmental-friendly non-vinyl chloride resin binder instead of a conventional vinyl chloride plastisol may be considered. However, since the use of aqueous textile printing agents in continuous printing would generate the following problems, the continuous printing using a multicolor rotating screen printing machine was impossible.

(Problem 1)

In the continuous printing using a multicolor rotating screen printing machine, the temperature of the pallet and screens inevitably increases and water contained in the aqueous textile printing composition evaporates, resulting in clogging of the screens; thus the continuous printing was impossible.

(Problem 2)

After printing, drying by far-infrared irradiation for 6-10 s using a far-infrared dryer is not sufficient for complete drying, and even if drying is completed, there occurs tack on the printed surface due to heating, resulting in adhesion of the printed surface to the back of the next screen upon its pressing during the next-step printing (blocking phenomenon).

Accordingly, when a multicolor rotating screen printing machine is used, because cooling of a printed surface as it is performed with an elliptical multi-station screen textile printing machine is impossible, the printed surface immediately after irradiation drying by a far-infrared dryer has a high temperature of approximately 80-100° C., and this temperature becomes approximately 60° C. when the printed surface is transferred to the next screen; under this circumstance, when a conventional binder resin consisting of an acrylic resin emulsion is used, tack develops on the printed surface at this temperature, leading to the occurrence of a blocking phenomenon of adhesion of the printed surface to the back of the next screen. Consequently, continuous printing using a multicolor rotating screen printing machine was impossible.

(Problem 3)

Since multicolor rotating screen printing machines have a smaller number of stages than elliptical multi-station screen textile printing machines, and it is impossible to equip far-infrared dryers and cooling points with a number corresponding to the number of colors, wet-on-wet printing should be adopted for multicolor printing of color textile printing compositions.

However, when continuous printing is performed using a conventional color textile printing composition and a multicolor rotating screen printing machine, upon contacting the printed surface with the back of the next screen, components of the textile printing composition of the printed surface attaches to the screen, i.e., a frame mark appears, and the components attached to the back of the screen accumulate to generate unevenness on the printed surface.

Consequently, it was impossible to perform continuous wet-on-wet printing on colored fabric using a multicolor rotating screen printing machine.

Therefore, printing with aqueous textile printing agents should be performed by hand screen textile printing using a long screen table or a T-shirt printing table, or by an elliptical multi-station screen textile printing machine in which more than 30 stages are equipped.

In hand screen textile printing, a printed surface is completely dried by a dryer or a fan after printing of each color, then the next ink is printed on the printed surface; accordingly, blocking or a frame mark does not develop. However, this is an extremely inefficient textile printing method wherein all the processes are performed by hand, which provides nonuniform textile printed materials.

When an elliptical multi-station screen textile printing machine is used, multicolor printing must be performed as follows: after each stage of printing, irradiation by a far-infrared dryer for 2 stages, and 2 stages of cooling to avoid blocking on the back of the next screen, then printing of the next ink is performed.

However, such textile printing method is only possible when the number of stages is large; for example, for 6 colors printing, a total of 32 stages including replacement of the fabric is necessary, which is extremely inefficient and requires a large installation area of equipment.

In addition, even with this textile printing method, defects such as clogging of screens due to evaporation of water contained in aqueous textile printing compositions and thickening of the compositions during continuous printing could not be avoided.

(2) Means of Solving the Problems

We found that the above problems could be solved by the following methods.

(Solution 1) Clogging of Screen

When a specific hydrophilic solvent and a moistening agent, namely, a hydrophilic solvent having a boiling point higher than that of water and urea, are blended in an aqueous textile printing composition, although a non-vinyl chloride resin is used, surprisingly the evaporation of water from the composition is suppressed, thereby preventing thickening of the composition and clogging of the screen.

Consequently, continuous printing becomes possible.

(Solution 2) Tack and Blocking

We found that this problem could be solved by using saturated polyester resin, polyamide resin, polyethylene resin, polyurethane resin, ethylene vinyl ester copolymer resin, silicone resin and acrylic silicone copolymer resin as a binder resin of aqueous textile printing compositions.

Namely, the use of the saturated polyester resin, polyamide resin, polyethylene resin, polyurethane resin, ethylene vinyl ester copolymer resin, silicone resin and acrylic silicone copolymer resin prevents tack on a printed surface generated by heat from irradiation drying by an far-infrared dryer after printing or by residual heat accumulation, and enables continuous printing without occurrence of blocking on the back of next screens.

The reason for this is considered to be as follows: since the saturated polyester resin, polyamide resin, polyethylene resin, polyurethane resin, ethylene vinyl ester copolymer resin, silicone resin and acrylic silicone copolymer resin used in the present invention have high crystallinity, they immediately crystallize even after being softened by heating; accordingly, even when tack develops, it disappears within several seconds after heating.

Consequently, wet-on-wet continuous printing becomes possible.

(Solution 3) Adhesion of Aqueous Color Textile Printing Composition to the Back of Screen When oil is blended in an aqueous color textile printing composition, the oil bleeds on a printed surface immediately after printing due to the heat from irradiation drying by a far-infrared dryer after printing, thereby preventing adhesion of the printing-composition component to the back of the next screen.

In addition, when oil is emulsified by an emulsion consisting of a nonionic surfactant having a cloud point between 30 and 90° C., the oil bleeds on a printed surface immediately after printing within a shorter period of time.

Consequently, continuous wet-on-wet printing becomes possible.

(3) Effects of Action

1) Since the aqueous textile printing composition (for white ground, for tack prevention or for coloring) contains a hydrophilic solvent having a boiling point higher than that of water and urea as an agent for the suppression of water evaporation, it does not thicken during continuous printing, and clogging is not developed.
2) The saturated polyester resin, polyamide resin, polyethylene resin, polyurethane resin, ethylene vinyl ester copolymer resin, silicone resin and acrylic silicone copolymer resin which are used as a binder resin for the tack-prevention textile printing composition have an effect to prevent tack as well as an anti-blocking property; therefore, tack is prevented, and blocking is not formed on the back of a screen during drying and heating after printing.
3) Since the color textile printing composition contains an oil which is an adhesion-prevention component to the back of screens and a nonionic surfactant having a cloud point between 30 and 90° C., wet-on-wet printing is possible.
4) By producing a white-ground textile printing layer beneath the tack-prevention textile printing layer, stretch properties and hiding power are improved.
5) Since printed materials do not contain vinyl chloride resin or a phthalate plasticizer, products with good breathability, light weight and good wash fastness can be obtained without causing environmental problems.
6) As stated above, the aqueous textile printing compositions of the present invention have superior printing characteristics, thus enabling the adoption of a multicolor rotating screen printing machine, and efficiently producing products with stable good quality.

Other reasons that the present invention shows superior printing characteristics are as follows.

(1) In the aqueous textile printing compositions, a hydrophilic solvent having a boiling point higher than that of water and urea are used as a water-evaporation suppression component.
(2) In the aqueous tack-prevention textile printing composition, saturated polyester resin, polyamide resin, polyethylene resin, polyurethane resin, ethylene vinyl ester copolymer resin, silicone resin and acrylic silicone copolymer resin, which have a tack-prevention action and an anti-blocking property, are used as a binder resin.
(3) In the aqueous color textile printing composition, oil and a nonionic surfactant having a cloud point between 30 and 90° C. are used as an adhesion-prevention component to the back of screens.

In the following, (A) aqueous textile printing compositions, (B) printing method, and (C) products of the present invention are explained.

(A) Aqueous Textile Printing Compositions

The aqueous textile printing compositions of the invention are used for multicolor rotating screen printing machines, which contain the following (1)-(10) as their components; here, the lamination of layers are formed with (1) an aqueous white-ground textile printing composition, (2) an aqueous tack-prevention textile printing composition, (3) an aqueous color textile printing composition, wherein the lamination generally consists of three layers, i.e., a lower layer (for white ground), a middle layer (for tack prevention) and an upper layer (for coloring). However, when the tack-prevention layer also acts as a hiding layer (i.e., containing white pigment), or the base material (fabric) is colorless (light color), the lamination of two layers with a lower layer (for tack prevention) and an upper layer (for coloring) is also possible.

In the following, components and lamination of the present aqueous textile printing compositions are explained.

<Components>

(1) Binder Resin

The binder resin is to provide stretch properties, fastness and tack-prevention property; non-vinyl chloride resins such as acrylic resin, saturated polyester resin, polyamide resin, polyethylene resin, polyurethane resin, ethylene vinyl ester copolymer resin, silicone resin, and acrylic silicone copolymer resin are used. The resins are selected in accordance with the objectives of the use as follows.

For white ground: acrylic resin, urethane resin.

For tack prevention: saturated polyester resin, polyamide resin, polyethylene resin, polyurethane resin, ethylene vinyl ester copolymer resin, silicone resin, acrylic silicone copolymer resin.

For coloring: acrylic resin, urethane resin.

The above resins may be used concomitantly. In addition, resins other than those described above may also be blended, within a range that the above-described functions as a resin are not lost.

Furthermore, within a range that the above-described functions as a resin are not lost, copolymerization or cocondensation products of the above-described resins or other resins may be used.

(2) Hydrophilic Solvent Having a Boiling Point Higher than that of Water

The hydrophilic solvent having a boiling point higher than that of water of the invention has a water-evaporation suppression characteristic, and is used for the suppression of evaporation of water from the aqueous textile printing composition of the invention; this is an important component of the present invention.

Namely, due to the water-evaporation suppression characteristic of the present hydrophilic solvent, thickening of the aqueous textile printing composition is suppressed and clogging of screens is prevented; as a result, printing characteristics improve, enabling continuous printing; thus, this is a very important component.

The water-evaporation suppression characteristic of the hydrophilic solvent is characterized in that it is further improved when the below-described urea is used concomitantly.

As the present hydrophilic solvent, for example, multivalent alcohol such as ethylene glycol, propylene glycol, glycerin, or diethylene glycol may be used.

Other than the above hydrophilic solvents, butyl cellosolve, butyl carbitol, 3-methoxy-3-methyl-1-butanol and the like as a hydrophilic solvent can be used concomitantly.

The amount of blending of a hydrophilic solvent is 5-25% by weight, and more preferably 10-20% by weight. When the amount is less than this value, clogging occurs during continuous printing, and when the amount is larger than this value, wash fastness of printed materials is decreased.

(3) Urea

The urea in the invention has a water-evaporation suppression effect, and is used to suppress evaporation of water from the aqueous textile printing composition of the invention. This is an important component of the invention.

Namely, due to the water-evaporation suppression characteristic of the present urea, thickening of the aqueous textile printing composition is suppressed and clogging of screens is prevented; as a result, printing characteristics improve, enabling continuous printing; thus, this is a very important component.

The water-evaporation suppression characteristic of the urea is characterized in that it is further improved when the above-described hydrophilic solvent is used concomitantly.

In addition, hyaluronic acid, sucrose and others may be used concomitantly with urea.

The amount of blending of urea is 1-10% by weight, and more preferably 3-8% by weight. When the amount is less than this value, clogging occurs during continuous printing, and when the amount is larger than this value, wash fastness of printed materials is decreased and the urea deposits on printed surfaces.

(4) White Pigment

The white pigment is used to hide colors of a base material such as fabric, and is blended into a white-ground textile printing composition or a tack-prevention textile printing composition.

As a white pigment, titanium oxide is used as a major component, to which precipitated barium sulfate, aluminum hydroxide, zinc oxide, aluminum silicate, silicate oxide and others may be combined.

(5) Coloring Pigment

The coloring pigment of the invention is blended in a color textile printing composition as a coloring agent for coloring (patterning) fabric.

As the coloring pigment, those which are generally used for printing may be used without limitation, for example, organic pigments such as azo pigments, quinacridone pigments, diketo pyrrole pigments, chromophthalic pigments, phthalocyanine pigments, indanthrone pigments, and dioxazine pigments, or inorganic pigments such as carbon black, ultramarine blue, iron blue, and titanium oxide may be used; other than these, extender such as aluminum silicate, calcium carbonate, precipitated barium sulfate, aluminum oxide, aluminum hydroxide, zinc oxide and silica, and phosphorescent pigments, pearl pigments, thermochromic pigments, and photochromic pigments may also be used.

(6) Inorganic Porous Material

The inorganic porous material has an improvement effect of surface staining power. When the inorganic porous material is blended in an aqueous tack-prevention textile printing composition, it increases the surface area of the composition, thereby improving the characteristics of a coloring pigment contained in an aqueous color textile printing composition laminated on the former composition, to provide a printed material with high concentration and clarity.

As an inorganic porous material, for example, silicon oxide, aluminum silicate, aluminum oxide, zeolite, sepiolite and others may be used, but not necessarily limited thereto; any porous materials may be used.

(7) Oil

The oil is used for aqueous color textile printing compositions, and has an action to prevent adhesion of components of a printed surface to the back of the next screen by its bleeding on the printed surface immediately after printing, thus enabling wet-on-wet printing; this is an important component.

As the oil, for example terpen, silicone oil, mineral oil, vegetable oil and others may be used.

(8) Nonionic Surfactant Having a Cloud Point Between 30 and 90° C.

The nonionic surfactant having a cloud point between 30 and 90° C. of the invention is used for aqueous color textile printing compositions, which is an important component having a function to bleed oil on the printed surface within a shorter period of time immediately after printing.

(9) Hardener

The hardener is blended to improve wash fastness of printed materials.

As a hardener, for example, methylol melamines, methylated methylol melamines, oxazoline hardeners, ethyleneimine hardeners, epoxy hardeners, ethylene urea hardeners, isocyanate hardeners, block isocyanate hardeners, silane coupling agents and others may be used, but it is not necessarily limited thereto and any agents which can improve wash fastness may be used.

(10) Other Additives

As other additives, for example, emulsifying agents, dispersing agents, thickeners, aqueous starch adhesives, antioxidizing agents, ultraviolet absorbers, antifoaming agents, leveling agents, plasticizers, fluorescent dyes, extender, thermoexpandable capsules, waxes, ester compounds, oils and others may be appropriately blended.

<Lamination>

With regard to lamination, there are usually three layers including a lower layer (aqueous white-ground textile printing composition), a middle layer (aqueous tack-prevention textile printing composition), and an upper layer (aqueous color textile printing composition). However, when a tack-prevention layer also acts as a hiding layer (containing a white pigment) or when a base material (fabric) is colorless (light color), the lamination of two layers with a lower layer (aqueous tack-prevention textile printing composition) and an upper layer (aqueous color textile printing composition) is also possible.

In the following, items of (1) aqueous white-ground textile printing composition, (2) aqueous tack-prevention textile printing composition, and (3) aqueous color textile printing composition are explained.

(1) Aqueous White-ground Textile Printing Composition

The aqueous white-ground textile printing composition of the invention is used to hide colors of a base material.

In the aqueous white-ground textile printing composition, among the above <Components>, (1) a binder resin consisting of acrylic resin or urethane resin, (2) a hydrophilic solvent having a boiling point higher than that of water, (3) urea, and (4) a white pigment are used as major components, into which, if necessary, (9) a hardener and (10) other additives can be appropriately blended.

The aqueous white-ground textile printing composition of the invention enables continuous printing with stretch properties and hiding power without occurrence of clogging, due to the inclusion of the above (2) hydrophilic solvent and (3) urea.

The aqueous white-ground textile printing composition is for printing a hiding layer on a colored fabric; for the provision of further hiding power, a printing method wherein said aqueous white-ground textile printing composition is printed with two or three times lamination is also possible.

In the following, among the above-mentioned components of the textile printing composition, (1) binder resin, (2) hydrophilic solvent having a boiling point higher than that of water, (3) urea, (4) white pigment, (9) hardener, and (10) other additives are explained.

<Binder Resin>

As the binder resin, acrylic resin or urethane resin may be used.

As the resin, acrylic resin, urethane resin or a combination thereof having stretch properties and a glass transition point (Tg) between −40 and 0° C. are suitable, and preferably, those having a Tg point between −35 and −20° C. are suitable. Resins with a Tg point less than −40° C. show residual stickiness in printed materials, with decreased wash fastness; and resins with a Tg point over 0° C. show hard texture of printed materials; thus these are not preferred.

The binder resin is preferably blended in a textile printing composition at a ratio of 10-40% by weight; when the ratio is less than 10% by weight, wash fastness is decreased, and when the ratio is over 40% by weight, printing workability deteriorates; thus these are not preferred.

<Hydrophilic Solvent Having a Boiling Point Higher than that of Water>

Since the present hydrophilic solvent, coupled with the urea below, suppresses the evaporation of water from an aqueous textile printing composition, thickening of the textile printing composition and clogging of screens can be prevented, thereby improving printing characteristics and, as a result, enabling continuous printing; thus, this is a very important component.

<Urea>

As mentioned above, since the present urea, coupled with the above hydrophilic solvent, suppresses the evaporation of water from an aqueous textile printing composition, thickening of the textile printing composition and clogging of screens can be prevented, thereby improving printing characteristics and, as a result, enabling continuous printing; thus, this is a very important component.

As the urea, those mentioned in the above <Components> (3) Urea may be used.

<Hardener>

To improve wash fastness of printed materials, a hardener may be blended. As the hardener, those mentioned in the above <Components>(9) Hardener may be used.

<Other Additives>

As other additives, those mentioned in the above<Components>(10) Other additives may be appropriately blended.

(2) Aqueous Tack-Prevention Textile Printing Composition

The aqueous tack-prevention textile printing composition of the invention is used for the prevention of tack generated on a printed surface during continuous printing involving heat drying, such as printing using a multicolor rotating printing machine, and is an essential textile printing composition in the present invention.

The aqueous tack-prevention textile printing composition is characterized in that it uses those consisting of saturated polyester resin, polyamide resin, polyethylene resin, polyurethane resin, ethylene vinyl ester copolymer resin, silicone resin, and acrylic silicone copolymer resin, as a binder resin.

With the aqueous tack-prevention textile printing composition, due to the tack-prevention effect of the saturated polyester resin, polyamide resin, polyethylene resin, polyurethane resin, ethylene vinyl ester copolymer resin, silicone resin, and acrylic silicone copolymer resin used as a binder resin, the tack generated on a printed surface by the heat from irradiation drying by an far-infrared dryer after printing and by the accumulation of residual heat disappears, resulting in non-occurrence of blocking on the back of the next screen; thus continuous printing becomes possible.

As mentioned above, by the use of the present aqueous tack-prevention textile printing composition, due to its superior tack-prevention characteristic and anti-blocking characteristic, the use of multicolor rotating printing machines becomes possible; thus, said textile printing composition is a key component of the present invention.

It is considered that, the saturated polyester resin, polyamide resin, polyethylene resin, polyurethane resin, ethylene vinyl ester copolymer resin, silicone resin, and acrylic silicone copolymer resin have a tack-prevention characteristic because they have high crystallinity, so that even when they are softened by heating, they immediately crystallize; accordingly, even if tack develops, the tack disappears within several seconds after heating.

The saturated polyester resin is polymerized by a polyvalent carboxylic acid with a polyvalent alcohol. Polyvalent carboxylic acids include terephthalic acid, isophthalic acid, orthophthalic acid, adipic acid, azelaic acid, sebacic acid, dimer acid, 5-sulfoisophthalate sodium, trimellitic acid, pyromellitic acid and the like. Polyvalent alcohols include ethylene glycol, 1,2-propylene glycol, neopentyl glycol, 1,4-butanediol, 1,5-pentanediol, 1,6-hexanediol, diethylene glycol, 1,4-cyclohexane dimethanol, ethylene oxide adduct of bisphenol A, trimethylolpropane, pentaerythritol and the like. By combining one or more polyvalent carboxylic acids with one or more polyvalent alcohols, saturated polyester resins with different Tg point, hardness, water resistance and crystallinity can be obtained.

In addition, those which partially co-polymerize acrylic resin, urethane resin and silicone resin may also be included.

The polyamide resin includes, for example, nylon 6, nylon 11, nylon 12, nylon 66, nylon 610, nylon 6T, nylon 6I, nylon 9T and the like; polycondensation products and cocondensation products thereof may also be included.

The polyethylene resin includes, for example, low-density polyethylene resin, high-density polyethylene resin, and ultralow-density polyethylene resin with a softening point of 70° C. or greater.

The polyurethane resin can be obtained by the reaction between a polyol component such as polyether polyol, polyester polyol, polycarbonate polyol, polyolefin polyol, acrylic polyol with monomers, dimmers and trimers of a isocyanate component such as tolylenediisocyanate, xylenediisocyanate, diphenyl methane diisocyanate (including hydrogenated products thereof), hexamethylene diisocyanate (including adduct, alophanate, biuret, and denatured isocyanurate thereof), isophorone diisocyanate, and naphthalene diusocyanate. Furthermore, those wherein the chain length thereof is extended by low-molecular polyols and amines may be used; and copolymerization with carboxylic denatured silicon, hydroxyl denatured silicon, and acrylic resin may also be used. Here, the use of urethane resins obtained by the reaction with a non-yellowing type aliphatic isocyanate is preferred in terms of light resistance.

As the ethylene vinyl ester copolymer resin, those obtained by high-pressure polymerization of 5-90 parts of ethylene with 10-95 parts of a vinyl ester component, such as vinyl acetate, vinyl propionate, vinyl lactate, vinyl pivalate, vinyl laurate and vinyl versatate may be used; depending on the combination of ethylene and vinyl ester, the ratio of polymerization and the degree of polymerization, resins with different softening point and hardness can be obtained. Here, phenol-denatured or carboxylic denatured ethylene vinyl ester copolymer resins may also be used; a portion of ethylene vinyl ester copolymer resins may be copolymerized with (meta)acrylic resins.

As the silicone resin, for example, hydrolytic polycondensation products of organic chlorosilane and organic alkoxysilane, thermosetting products having a 3-D network structure produced by heating or under the presence of catalyst, or polycondensation products of tetramers or pentamers of cyclic silicone may be used; depending on the combination and the degree of polymerization, resins with different softening point, hardness and water resistance can be obtained.

As the acrylic silicone copolymer resin, for example, those obtained by polycondensation and copolymerization of an acrylic component, such as methyl(meth)acrylate, ethyl (meth)acrylate, butyl(meth)acrylate, propyl acrylate, hexyl acrylate, heptyl(meth)acrylate, 2-ethyl hexyl methyl(meth) acrylate, octyl(meth)acrylate, amyl(meth)acrylate, decyl (meth)acrylate, lauryl(meth)acrylate, stearyl(meth)acrylate, acrylamide, 2-hydroxyethyl(meth)acrylate, 2-hydroxypropyl (meth)acrylate, dimethylaminoethyl(meth)acrylate, dimethylaminopropyl(meth)acrylate, and 2-acrylamide-2-methylpropane sodium sulfonate, with the above-mentioned silicone resin may be used. In addition, copolymerization of acrylic acid, methacrylic acid, maleic acid, itaconic acid, and crotonic acid as a functional group is also possible. The copolymers with different softening point, hardness and water resistance can be obtained depending on the combination and the degree of polymerization.

Here, the resin emulsion (dispersion) of the present invention is not limited to those mentioned above; any other emulsions (dispersions) which can provide physical properties of interest of the invention may be used.

In addition, upon emulsifying resins, the use of surfactant is allowed; also, emulsions (dispersions) without surfactant may be produced by self-emulsification wherein hydrophilic functional groups are copolymerized in resin molecules.

Moreover, after polymerization in a solution, the solvent can be removed by placing the reaction product into water, and emulsions (dispersions) may be produced by dispersing pellets in water after freezing and pulverization.

Furthermore, a powdered resin may be blended into another emulsion resin (for example, acrylic resin, etc.) to be used as a resin of the tack-prevention component.

As the saturated polyester resin, polyamide resin, polyethylene resin, polyurethane resin, ethylene vinyl ester copolymer resin, silicone resin, and acrylic silicone copolymer resin, those which have a glass transition point (Tg) between −40 and 30° C. are preferred, and between −30 and −20° C. are more preferred. Those with a Tg point less than −40° C. show residual stickiness in printed materials and decreased wash fastness, and those with a Tg point over 30° C. shows hard texture of printed materials; thus both types are not preferred.

The binder resin consisting of saturated polyester resin, polyamide resin, polyethylene resin, polyurethane resin, ethylene vinyl ester copolymer resin, silicone resin, and acrylic silicone copolymer resin is preferably blended in a textile printing composition at a ratio of 5-35% by weight. When the ratio is less than 5% by weight, the resin shows a deteriorated effect of tack prevention, and when the ratio is more than 35% by weight, its printing workability deteriorates; thus, both types are not preferred.

In the aqueous tack-prevention textile printing composition, it is possible to blend a white pigment and to print the blended composition by 2- to 3-times lamination; in this case, as a white pigment, those mentioned in the above <Components> (4) White pigment may be used.

When the aqueous white-ground textile printing composition is laminated onto a lower layer, since the hiding power can be obtained from this aqueous white-ground textile printing composition, the aqueous tack-prevention textile printing composition can be used as a colorless textile printing composition without blending a white pigment.

When abase material (fabric) is colorless or light colored, since hiding power is not required, a colorless aqueous tack-prevention textile printing composition may be used.

Furthermore, when more stretch properties are required, first, an aqueous white-ground textile printing composition having superior stretch properties consisting of acrylic resin or/and urethane resin is printed 1 to 2 times, and irradiation drying using a far-infrared dryer is performed, then an aqueous tack-prevention textile printing composition is laminated using a screen with a design identical to the previous screen; with this process, printed materials with further stretch properties can be obtained.

The aqueous tack-prevention textile printing composition contains, among the above <Components>, (1) a binder resin consisting of saturated polyester resin, polyamide resin, polyethylene resin, polyurethane resin, ethylene vinyl ester copolymer resin, silicone resin, and acrylic silicone copolymer resin, (2) a hydrophilic solvent having a boiling point higher than that of water, and/or (3) urea as major components, into which, if necessary, (4) a white pigment, (6) an inorganic porous material, (9) a hardener and (10) other additives, etc. are blended so as to provide more superior printing characteristics.

The aqueous tack-prevention textile printing composition of the invention is similar to the above (1) aqueous white-ground textile printing composition, in that it enables continuous printing with stretch properties and hiding power without clogging during continuous printing using a multicolor rotating screen printing machine, when a hydrophilic solvent having a boiling point higher than that of water and/or urea are contained for superior water-evaporation suppression characteristic.

In the following, the components other than the above-mentioned binder-resin components, i.e., (2) hydrophilic solvent having a boiling point higher than that of water, (3) urea, (4) white pigment, (6) inorganic porous material, (9) hardener, and (10) other additives are explained.

<Hydrophilic Solvent Having a Boiling Point Higher than that of Water>

Since the present hydrophilic solvent, coupled with the urea below, suppresses the evaporation of water from the aqueous textile printing composition of the invention, clogging of screens and thickening of the textile printing composition can be prevented, thereby improving printing characteristics and, as a result, enabling continuous printing; thus, this is a very important component.

As the hydrophilic solvent having a boiling point higher than that of water, those mentioned in the above <Components> (2) Hydrophilic solvent having a boiling point higher than that of water may be used.

<Urea>

Since the present urea, coupled with the above hydrophilic solvent, suppresses the evaporation of water from the aqueous textile printing composition, clogging of screens and thickening of the textile printing composition can be prevented, thereby improving printing characteristics and, as a result, enabling continuous printing; thus, this is a very important component.

As the urea, those mentioned in the above <Components> (3) Urea may be used.

<White Pigment>

The aqueous tack-prevention textile printing composition can contain a white pigment to produce a hiding layer, and can be used as a white textile printing composition.

As the white pigment, those mentioned in the above <Components> (4) White pigment may be used.

<Inorganic Porous Material>

The inorganic porous material has a surface-staining-power enhancement effect, and is blended into an aqueous tack-prevention textile printing composition to increase the surface area of the composition, thereby improving the characteristic of a coloring pigment contained in an aqueous color textile printing composition that is laminated thereon, so that printed materials with higher concentration and more clarity can be obtained.

As the inorganic porous material, those mentioned in the above <Components> (6) Inorganic porous material may be used.

<Hardener>

To improve wash fastness of printed materials, a hardener may be added.

As the hardener, those mentioned in the above <Components> (9) Hardener may be used.

<Other Additives>

Those mentioned in the above <Components> (10) Other additives may be blended as the other additive.

(3) Aqueous Color Textile Printing Composition

The aqueous color textile printing composition of the invention is used for continuous printing of colors (patterns) on a base material such as fabric.

The aqueous color textile printing composition contains, among the above <Components>, (1) a binder resin consisting of acrylic resin and urethane resin, (2) a hydrophilic solvent having a boiling point higher than that of water, (3) urea, (5) a coloring pigment, (7) oil, and (8) a nonionic surfactant having a cloud point between 30 and 90° C. as major components, into which, if necessary, (9) a hardener and (10) other additives, etc. may be blended.

Namely, since the aqueous color textile printing composition contains an oil, wet-on-wet printing becomes possible; in addition, since said composition contains a nonionic surfactant having a cloud point between 30 and 90° C. as an emulsifying agent, more superior wet-on-wet printing becomes possible; furthermore, since said composition contains a hydrophilic solvent having a boiling point higher than that of water and/or urea which have a water-evaporation suppression characteristic, clogging can be prevented.

As a result, the use of said textile printing composition enables continuous multicolor printing using multicolor rotating screen printing machines.

In the following, each component of (1), (2), (3), (5), (7), (8), (9), (10) is explained.

<Binder Resin>

Binder resins are used to provide fastness. Binder resins include acrylic resin and urethane resin having a glass transition point (Tg) between −40 and 0° C., and a combination thereof, and preferably, those having a Tg point between −35 and −10° C. Resins with a Tg point less than −40° C. show residual stickiness in printed materials, with decreased wash fastness; and resins with a Tg point over 0° C. show hard texture of printed materials; thus these are not preferred.

The binder resin blended in a textile printing composition at a ratio of 5-40% by weight is preferred in terms of stretch properties, texture and wash fastness; when the ratio is less than 5% by weight, wash fastness is decreased, and when the ratio is over 40% by weight, printing workability deteriorates; thus these are not preferred.

<Hydrophilic Solvent Having a Boiling Point Higher than that of Water>

Since the present hydrophilic solvent, coupled with the urea below, suppresses the evaporation of water from an aqueous textile printing composition of the invention, clogging of screens and thickening of the textile printing composition can be prevented, thereby improving printing characteristics and, as a result, enabling continuous printing; thus, this is a major component of the color textile printing composition.

As the hydrophilic solvent having a boiling point higher than that of water, those mentioned in the above <Components> (2) Hydrophilic solvent having a boiling point higher than that of water may be used.

<Urea>

As mentioned above, since the urea, coupled with the above hydrophilic solvent, suppresses the evaporation of water from an aqueous textile printing composition, clogging of screens and thickening of the textile printing composition can be prevented, thereby improving printing characteristics and, as a result, enabling continuous printing; thus, this is a major component of the color textile printing composition.

As the urea, those mentioned in the above <Components> (3) Urea may be used.

<Coloring Pigment>

The coloring pigment of the invention is used for color printing, and it is a major component of the present color textile printing composition.

As the coloring pigment, those which are generally used for printing may be used without limitation, for example, organic pigments such as azo pigments, quinacridone pigments, diketo pyrrole pigments, chromophthalic pigments, phthalocyanine pigments, indanthrone pigments, and dioxazine pigments, or inorganic pigments such as carbon black, ultramarine blue, iron blue, and titanium oxide may be used; other than these, extender such as aluminum silicate, calcium carbonate, precipitated barium sulfate, aluminum oxide, aluminum hydroxide, zinc oxide and silica, and phosphorescent pigments, pearl pigments, thermochromic pigments, and photochromic pigments may also be used.

<Oil>

The oil has an effect to prevent adhesion of a binder contained in a printed surface to the back of the next screen by its bleeding on the printed surface immediately after printing, thus it is used to enable wet-on-wet printing; this is a major component of the color textile printing composition.

As the oil, for example, silicone oil, mineral oil, vegetable oil, terpen and others may be used.

The amount of blending of oil is 5-50% by weight, and preferably 10-35% by weight. When the amount of blending is less than 5% by weight, adhesion of the binder contained in a printed surface to the back of the next screen cannot be prevented, and when the amount of blending is larger than 50% by weight, problems such as unstable emulsification, danger of fire during drying processes, and decreased wash fastness may arise, which is not preferred.

<Nonionic Surfactant Having a Cloud Point Between 30 and 90° C.>

The nonionic surfactant having a cloud point between 30 and 90° C. of the invention is used with the aim of making the oil bleed on a printed surface within a shorter time immediately after printing.

Namely, the nonionic surfactant used for the emulsification of oil has a problem in that when the emulsified product is subjected to a temperature higher than the cloud point of this surfactant, the emulsification becomes unstable, leading to bleeding of the oil on the printed surface within a short time. Accordingly, the cloud point is determined with consideration given to the temperature generated due to heat by a far-infrared dryer of a circular multicolor screen printing machine and accumulation of residual heat.

When the cloud point of the nonionic surfactant is less than 30° C., emulsification of a binder under normal temperature becomes unstable, and the binder lacks stability during its storage due to the separation of the oil; in addition, the oil is separated prior to the printing process, thus it is not preferred. When the cloud point is higher than 90° C., since the temperature caused by heat from a dryer and residual heat does not exceed the cloud point, emulsification does not become unstable; accordingly, the objective of bleeding the oil on a printed surface within a short time cannot be achieved.

The nonionic surfactant includes, for example, polyoxyethylene lauryl ether, polyoxyethylene cetyl ether, polyoxyethylene stearyl ether, polyoxyethylene oleyl ether, polyoxyethylene higher alcohol ether, polyoxyalkylene alkyl ether, polyoxyethylene octyl phenyl ether, polyoxyethylene nonyl phenyl ether, polyoxyethylene styrenated phenyl ether, polyoxyethylene caster oil, polyoxyethylene hardened caster oil, polyoxyethylene oleic ester, polyoxyethylene polyoxypropylene block polymer and others, but not limited thereto; general nonionic surfactants and anionic surfactants can be used concomitantly.

<Hardener>

To improve wash fastness of printed materials, a hardener may be blended.

As the hardener, those mentioned in the above <Components> (9) hardener may be used.

<Other Additives>

Those mentioned in the above <Components> (10) Other additives may be blended as the other additives.

(B) Printing Method

1) Textile Printing Method

Printing of the above-mentioned aqueous white-ground textile printing composition, aqueous tack-prevention textile printing composition, aqueous color textile printing composition and others can be performed using a multicolor rotating screen printing machine in a continuous printing manner.

For example, using a multicolor rotating screen printing machine, a continuous printing method on a base material (fabric) with a sequence of (a) printing of an aqueous continuous textile printing composition for white ground (0-2 times), (b) printing of an aqueous tack-prevention textile printing composition (1 to several times), (c) printing of an aqueous color textile printing composition (1 to several times) can be adopted.

2) Aftertreatment

<Drying>

Since a material printed by the present invention is in a semidried condition immediately after it is taken out from a printing machine, the material is subjected to drying. Generally, a tunnel dryer is used, wherein the printed material is placed on a belt conveyer, which is automatically transferred into a tunnel furnace where hot air with a temperature of 100-200° C. is generated for 1-3 minutes drying.

Here, as a drying facility, a batch drying facility can be used in addition to tunnel dryers; natural drying may also be adopted.

<Heat Treatment>

The fastness of the above-dried printed materials can be improved by heat treatment at 120-150° C. for 3-5 minutes.

As a heat treatment apparatus, treatment by a tunnel dryer for 1-3 times may be applied; heat treatment using other batch-type dryers is also possible.

3) Printing Machine

Since the aqueous continuous printing composition of the invention is suitable for continuous printing, preferably, printing is performed using a multicolor rotating screen printing machine.

In the multicolor rotating screen printing machine, stages consisting of a screen onto which a screen mesh is extended and a dryer are placed radial to the center of a turntable at its circumference, and this is a rotating (turntable type) automatic printing machine capable of multicolor screen printing by rotating and revolving a pallet (printing table) intermittently around the turntable.

The multicolor rotating screen printing machine consists of a total of 8-20 stages, including one null stage each for the placement and removal of materials to be printed (a screen and a dryer are not equipped), 1-5 stages with a far-infrared dryer, and remaining stages with a screen.

The upper plane of the printing table is sticky so that a fabric does not detach from the table during printing processes. Placement and removal of the fabric is generally performed by hand, keeping time with the action of the multicolor rotating screen printing machine.

As a multicolor rotating screen printing machine, for example, Synchroprint from The MHM Company, Challenger from The M&R Companies, and Hawk Compact from TAS International are available, but it is not necessarily limited thereto. Any machines capable of performing similar textile printing processes may be used.

Here, as printing machines other than above, an elliptical multi-station screen textile printing machine from which a part of coolers and dryers are terminated or removed may be used as a printing machine similar to the multicolor rotating printing machine; by using the aqueous textile printing composition of the present invention, this machine may be used to reduce the number of printing processes and man power, and to improve efficiency, compared with a textile printing method using conventional elliptical multi-station screen textile printing machines.

Therefore, such machines used for continuous textile printing are included in the scope of the present invention.

(C) Products

The products are produced by continuous printing of the aqueous white-ground textile printing composition, aqueous tack-prevention textile printing composition, aqueous color textile printing composition and others, on a clothing or fabric by the above textile printing methods, using a multicolor rotating screen printing machine.

Fabrics include synthetic fibers such as nylon, polyester, acrylonitrile, etc., semisynthetic fibers such as acetate, rayon, etc., natural fibers such as cotton, silk, wool, etc., and combinations thereof, woven fabrics, nonwoven fabrics and others.

Clothing includes T shirts, sweat shirts, jerseys, pants, sweat suits and others.

Effects of the Invention (1) Since the aqueous continuous textile printing compositions (for white ground, for tack prevention, for coloring) contain a hydrophilic solvent having a boiling point higher than that of water and/or urea as a water-evaporation prevention component, the compositions do not cause clogging due to drying, etc. during continuous printing.

(2) Due to the tack-prevention characteristic and anti-blocking characteristic of resins used as a binder resin of the aqueous tack-prevention textile printing composition, wherein the resins include saturated polyester resin, polyamide resin, polyethylene resin, polyurethane resin, ethylene vinyl ester copolymer resin, silicone resin, and acrylic silicone copolymer resin, the occurrence of tack is prevented, and blocking is not formed on the back of the screens after drying and heating following printing.

(3) Since the color textile printing composition contains oil as a component to prevent adhesion to the back of screens, as well as a nonionic surfactant having a cloud point between 30 and 90° C., wet-on-wet printing is enabled.

(4) By the formation of a white-ground textile printing layer as a hiding layer beneath a tack-prevention textile printing layer, the hiding power and stretch properties can be improved.

(5) Due to the use of an aqueous non-vinyl-resin textile printing composition without containing a phthalate plasticizer, the textile printing composition does not cause environmental problems, and the products of the invention, namely the printed materials, show good breathability, light weight and superior wash fastness.

(6) Thus, the aqueous textile printing compositions of the invention have superior printing characteristics, enabling the adoption of a multicolor rotating screen printing machine, and allowing efficient production of products with superior quality.

EMBODIMENTS FOR CARRYING OUT THE INVENTION

In the following, the invention is further explained in detail with reference to examples; however, the scope of the invention is not limited thereto.

In the examples below, "parts" and "%" indicate "parts by weight" and "% by weight", respectively, unless otherwise noted.

EXAMPLE 1

<Preparation of Aqueous White-ground Textile Printing Composition>

The following components were mixed to obtain 102 parts of a homogenous aqueous white-ground textile printing composition: 45 parts of an emulsion containing 60% of acrylic resin having a Tg point of −30° C. (NIKASOL FX-138Y: Nippon Carbide Industries, Co., Inc.), 10 parts of propylene glycol, 4 parts of urea, 30 parts of titanium oxide (Titan R-630: ISHIHARA SANGYO Co., Ltd.), 1 part of 20% sodium hexametaphosphate solution, 0.5 parts of a silicone antifoaming agent (Silicone KM-71: Shin-Etsu Chemical Co., Ltd.), 0.5 parts of ammonia water, 3 parts of a thickener (VONCOAT V: Dainippon Ink and Chemicals, Incorporated), 6 parts of water, and 2 parts of an ethylene urea hardener (MATSUMIN FIXER F: Matsui Shikiso Chemical Co., Ltd.).

<Preparation of Aqueous Tack-prevention Textile Printing Composition>

The following components were mixed to obtain 100 parts of a homogenous aqueous tack-prevention textile printing composition of white color: 40 parts of an emulsion containing 25% of saturated polyester resin having a Tg point of −26° C. (KZT-0507: UNITIKA LTD.), 15 parts of ethylene glycol, 4 parts of urea, 1 part of 20% sodium hexametaphosphate solution, 20 parts of titanium oxide (Titan R-630: ISHIHARA SANGYO Co., Ltd.), 1 part of a silicone antifoaming agent (Silicone KM-71: Shin-Etsu Chemical Co., Ltd.), 0.3 parts of ammonia water, 2.5 parts of a thickener (PRIMAL TT615: Rohm & Haas Japan K.K.), 14.2 parts of water, and 2 parts of an ethylene urea hardener (MATSUMIN FIXER F: Matsui Shikiso Chemical Co., Ltd.).

<Preparation of Aqueous Color Textile Printing Composition>

The following components were mixed to obtain 100 parts of a homogenous aqueous color textile printing composition of red color: 30 parts of an emulsion containing 40% of acrylic resin having a Tg point of −20° C. (VINYSOL EP-6020: Daido Chemical Corporation), 10 parts of ethylene glycol, 3 parts of urea, 23 parts of terpen, 2 parts of silicone oil (Silicone SH200: Dow Corning Toray Silicone, Co., Ltd.), 3 parts of a nonionic surfactant having a cloud point of 40° C. (EMULGEN 108: Kao Corporation), 19 parts of water, 2 parts of an ethylene urea hardener (MATSUMIN FIXER F: Matsui Shikiso Chemical Co., Ltd.), and 8 parts of a red-pigment dispersing solution (MATSUMIN Neo Color Red MFB: Matsui Shikiso Chemical Co., Ltd.).

In addition, aqueous color textile printing compositions of three colors (yellow, blue, and black) were obtained similarly to the preparation of the above composition of red color, except that in place of the above red-pigment dispersing solution (MATSUMIN Neo Color Red MFB), a yellow-pigment dispersing solution (MATSUMIN Neo Color Gold-yellow MFR: Matsui Shikiso Chemical Co., Ltd.), a blue-pigment dispersing solution (MATSUMIN Neo Color blue MB: Matsui Shikiso Chemical Co., Ltd.), and a black-pigment dispersing solution (MATSUMIN Neo Color Black MK: Matsui Shikiso Chemical Co., Ltd.), respectively, were used.

<Textile Printing Method Using Multicolor Rotating Screen Printing Machine>

Continuous multicolor screen printing was performed by repeating the following processes using Nos. 1-16 stations of the multicolor rotating screen printing machine (16 stages: The M&R Companies). Prior to the start of printing, only far-infrared dyers were activated to heat each pallet to a temperature of 50-60° C.

No. 1 station: A dark blue T shirt is placed on the pallet which has been previously coated with an adhesive agent.

No. 2 station: The aqueous white-ground textile printing composition is printed using an 80-mesh screen with patterns of A, B, C, D and E.

No. 3 station: The aqueous white-ground textile printing composition is dried using the far-infrared dyer.

No. 4 station: The aqueous tack-prevention textile printing composition is printed by superimposition on the patterns of A, B, C, D and E using a 80-mesh screen with a design identical to that of No. 2 station.

No. 5 station: The aqueous tack-prevention textile printing composition is dried using the far-infrared dyer.

Nos. 6-9 stations: The aqueous color textile printing compositions are printed in a wet-on-wet manner using four 120-mesh screens, with red on the entire pattern B, yellow on the entire pattern C, blue on the entire pattern D, and black on the entire pattern E.

Nos. 10-15 stations: Null stages.

No. 16 station: The printed T shirt is removed from the machine.

After the textile printing process using the multicolor rotating screen printing machine, the printed T shirt was dried by a tunnel dryer at 120° C. for 2 minutes, then heat-treated at 130° C. for 3 minutes.

When 2000 T shirts were printed continuously, the temperature of each pallet was 40-70° C. No clogging of screens with each binder or no thickening of binders occurred during the continuous printing, and no tack developed on the surface of the aqueous tack-prevention textile printing composition after drying by the far-infrared dryer of No. 5 station, no blocking of the printed surface on the back of the next screen occurred; in addition, there was no adhesion of the binder in the 4 colors of aqueous color textile printing compositions on the printed surface to the screens, and no unevenness were present on the printed surfaces.

Thus-obtained T shirts had the white pattern A, red pattern B, yellow pattern C, blue pattern D and black pattern E on the dark blue fabric, with light weight, showing good hiding power and stretch properties.

Furthermore, the T shirts were subjected to 30 times of repeated tests according to the wash fastness test JIS L-0217 103, and showed good wash fastness. Moreover, there was no difference in the quality between the first T shirt and the $2000^{th}$ T shirt.

EXAMPLE 2

In this Example 2, processes of textile printing, drying and heat treatment identical to those in Example 1 were performed, except that the far-infrared dryer in No. 3 station in the textile printing process was cancelled, and that wet-on-wet printing was applied for the aqueous white ground textile printing composition in No. 2 station and the aqueous tack-prevention textile printing composition in No. 4 station.

Continuous printing was achieved using the rotating screen printing machine without any problems, as in the case of Example 1, and the quality of T shirts obtained was similar to that in Example 1.

EXAMPLE 3

<Preparation of Aqueous Tack-prevention Textile Printing Composition>

The following components were mixed to obtain 100 parts of a homogenous aqueous tack-prevention textile printing composition of white color: 30 parts of a dispersion containing 25% of saturated polyester resin having a Tg point of −30° C. (PESRESIN A-160P: TAKAMATSU OIL&FAT CO., LTD.), 10 parts of an emulsion containing 50% of urethane resin having a Tg point of −25° C. (PERMARIN UA368: Sanyo Chemical Industries, Ltd.), 15 parts of ethylene glycol, 3 parts of urea, 1 part of 20% sodium hexametaphosphate solution, 20 parts of titanium oxide (Titan R-650: ISHIHARA SANGYO Co., Ltd.), 1 part of a silicone antifoaming agent (Silicone KM-71: Shin-Etsu Chemical Co., Ltd.), 0.3 parts of ammonia water, 2 parts of a thickener (PRIMAL TT615: Rohm & Haas Japan K.K.), 15.7 parts of water, and 2 parts of an ethylene urea hardener (MATSUMIN FIXER F: Matsui Shikiso Chemical Co., Ltd.).

<Textile Printing Method Using Multicolor Rotating Screen Printing Machine>

Processes of textile printing, drying and heat treatment identical to those in Example 1 were performed, except that the printing of the aqueous white-ground textile printing composition in No. 2 station and the far-infrared dryer in No. 3 station in the printing process were cancelled, and that the aqueous tack-prevention textile printing composition in No. 4 station was replaced by the above textile printing composition.

Continuous printing was achieved using the rotating screen printing machine without any problems, as in the case of Example 1.

The quality of T shirts obtained was sufficient for practical use, although the hiding power, stretch properties and wash fastness were slightly inferior to those in Example 1 due to the absence of the white ground layer.

EXAMPLE 4

<Preparation of Aqueous Color Textile Printing Composition>

The following components were mixed to obtain 100 parts of a homogenous aqueous color textile printing composition of cyanogen: 33 parts of an emulsion containing 50% of acrylic resin having a Tg point of −15° C. (YODOSOL 225-4260J: National Starch and Chemical Co. ), 13 parts of ethylene glycol, 4 parts of urea, 20 parts of terpen, 2 parts of silicone oil (Silicone SH200: Dow Corning Toray Silicone, Co., Ltd.), 3 parts of a nonionic surfactant having a cloud point of 55° C. (EMULGEN 409P: Kao Corporation), 18 parts of water, 2 parts of an ethylene urea hardener (MATSUMIN FIXER F: Matsui Shikiso Chemical Co., Ltd.), and 5 parts of a blue-pigment dispersing solution (MATSUMIN Neo Color Blue MG: Matsui Shikiso Chemical Co., Ltd.).

In addition, aqueous color textile printing compositions of three colors (magenta, yellow, and black) were obtained similarly to the preparation of the above composition of cyanogen, except that in place of the above blue-pigment dispersing solution (MATSUMIN Neo Color Blue MG), a pink-pigment dispersing solution (MATSUMIN Neo Color Pink MB: Matsui Shikiso Chemical Co., Ltd.), a yellow-pigment dispersing solution (MATSUMIN Neo Color Yellow M3G: Matsui Shikiso Chemical Co., Ltd.), and a black-pigment dispersing solution (MATSUMIN Neo Color Black MK: Matsui Shikiso Chemical Co., Ltd.), respectively, were used.

<Textile Printing Method Using Multicolor Rotating Screen Printing Machine>

Processes of textile printing, drying and heat treatment identical to those in Example 1 were performed, except that a process identical to the screen printing of the aqueous white-ground textile printing composition of No. 2 station was performed between No. 3 and No. 4 stations during the printing process, and that the aqueous color textile printing composition used in Nos. 6-9 stations were replaced by the above aqueous color textile printing compositions of cyanogen, magenta, yellow and black.

Here, the fabric used was a red cut-fabric, and the printing pattern was changed from the patterns ABCDE in Example 1 to a dog's photo pattern on a 150-mesh screen in the printing process.

Continuous printing of 1000 fabrics was achieved using the rotating screen printing machine without any problems, as in the case of Example 1.

The cut-fabrics obtained had a clearly-printed dog's photo pattern on the red fabric, and their hiding power, stretch properties and wash fastness were superior to those in Example 1 because of the increased number of white ground layers by 1. In addition, there was no difference in the printing quality between the first cut-fabric and $1000^{th}$ cut-fabric.

EXAMPLE 5

<Preparation of Aqueous Tack-prevention Textile Printing Composition>

The following components were mixed to obtain 100 parts of a homogenous aqueous tack-prevention textile printing composition of white color: 30 parts of an emulsion containing 40% of saturated polyester resin having a Tg point of 19° C. (SEPOLSION ES900: SUMITOMO SEIKA CHEMICALS CO., LTD.), 10 parts of an emulsion containing 50% of urethane resin having a Tg point of −25° C. (PERMARIN UA368: Sanyo Chemical Industries, Ltd.), 15 parts of ethylene glycol, 4 parts of urea, 1 part of 20% sodium hexametaphosphate solution, 10 parts of silica (Sylysia 780: FUJI SILYSIA CHEMICAL LTD.), 1 part of a silicone antifoaming agent (Silicone KM-71: Shin-Etsu Chemical Co., Ltd.), 0.3 parts of ammonia water, 2 parts of a thickener (PRIMAL TT615: Rohm & Haas Japan K.K.), 24.7 parts of water, and 2 parts of an ethylene urea hardener (MATSUMIN FIXER F: Matsui Shikiso Chemical Co., Ltd.).

<Textile Printing Method Using Multicolor Rotating Screen Printing Machine>

Processes of textile printing, drying and heat treatment identical to those in Example 4 were performed, except that the aqueous tack-prevention textile printing composition used in Example 4 was replaced by the above textile printing composition.

Continuous printing of 1000 fabrics was achieved using the rotating screen printing machine without any problems, as in the case of Example 4.

The cut-fabrics obtained had a dog's photo pattern on the red fabric with a higher coloring concentration and clarity, having superior stretch properties and wash fastness similar to those in Example 4, although the hiding power was slightly inferior to that in Example 4 because titanium oxide was not blended in the aqueous tack-prevention textile printing composition.

In addition, there was no difference in the printing quality between the first cut-fabric and $1000^{th}$ cut-fabric.

EXAMPLE 6

<Preparation of Aqueous Tack-prevention Textile Printing Composition>

The following components were mixed to obtain 100 parts of a homogenous aqueous tack-prevention textile printing composition of white color: 40 parts of a dispersion containing 40% of polyamide resin having a Tg point of +22° C. (SEPOLSION PA: SUMITOMO SEIKA CHEMICALS CO., LTD.), 15 parts of ethylene glycol, 4 parts of urea, 1 part of 20% sodium hexametaphosphate solution, 5 parts of silica (Sylysia 780: FUJI SILYSIA CHEMICAL LTD.), 0.5 parts of a nonionic surfactant (EMULGEN 4085: Kao Corporation), 1 part of a silicone antifoaming agent (Silicone KM-71: Shin-Etsu Chemical Co., Ltd.), 0.3 parts of ammonia water, 2.5 parts of a thickener (PRIMAL TT615: Rohm & Haas Japan K.K.), 28.7 parts of water, and 2 parts of an ethylene urea hardener (MATSUMIN FIXER F: Matsui Shikiso Chemical Co., Ltd.).

<Textile Printing Method Using Multicolor Rotating Screen Printing Machine>

Processes of textile printing, drying and heat treatment identical to those in Example 5 were performed, except that the aqueous tack-prevention textile printing composition used in Example 5 was replaced by the above textile printing composition.

Continuous printing of 1000 fabrics was achieved using the multicolor rotating screen printing machine without any problems, as in the case of Example 5.

The quality of the cut-fabrics obtained was identical to that in Example 5.

EXAMPLE 7

<Preparation of Aqueous Tack-prevention Textile Printing Composition>

The following components were mixed to obtain 100 parts of a homogenous aqueous tack-prevention textile printing composition of white color: 20 parts of a dispersion containing 25% of saturated polyester resin having a Tg point of −30° C. (PESRESIN A-160P: TAKAMATSU OIL&FAT CO., LTD.), 20 parts of an emulsion containing 44% of silicone resin (KM-2002L-1: Shin-Etsu Chemical Co., Ltd.), 17 parts of ethylene glycol, 3 parts of urea, 1 part of 20% sodium hexametaphosphate solution, 20 parts of titanium oxide (Titan R-650: ISHIHARA SANGYO Co., Ltd.), 1 part of a silicone antifoaming agent (Silicone KM-71: Shin-Etsu Chemical Co., Ltd.), 0.3 parts of ammonia water, 2 parts of a thickener (PRIMAL TT615: Rohm & Haas Japan K.K.), 13.7 parts of water, and 2 parts of an ethylene urea hardener (MATSUMIN FIXER F: Matsui Shikiso Chemical Co., Ltd.).

<Textile Printing Method Using Multicolor Rotating Screen Printing Machine>

Processes of textile printing, drying and heat treatment identical to those in Example 1 were performed, except that the aqueous tack-prevention textile printing composition used in Example 1 was replaced by the above textile printing composition.

Continuous printing of 1000 fabrics was achieved using the multicolor rotating screen printing machine without any problems, as in the case of Example 1.

The quality of the cut-fabrics obtained was identical to that in Example 1.

EXAMPLE 8

<Preparation of Aqueous Tack-prevention Textile Printing Composition>

The following components were mixed to obtain 100 parts of a homogenous aqueous tack-prevention textile printing composition of white color: 40 parts of an emulsion containing 40% of silicone acrylic resin (X22-8084EM: Shin-Etsu Chemical Co., Ltd.), 15 parts of ethylene glycol, 4 parts of urea, 1 part of 20% sodium hexametaphosphate solution, 20 parts of titanium oxide (Titan R-650: ISHIHARA SANGYO Co., Ltd.), 1 part of a silicone antifoaming agent (Silicone KM-71: Shin-Etsu Chemical Co., Ltd.), 0.3 parts of ammonia water, 2 parts of a thickener (PRIMAL TT615: Rohm & Haas Japan K.K.), 14.7 parts of water, and 2 parts of an ethylene urea hardener (MATSUMIN FIXER F: Matsui Shikiso Chemical Co., Ltd.).

<Textile Printing Method Using Multicolor Rotating Screen Printing Machine>

Processes of textile printing, drying and heat treatment identical to those in Example 3 were performed, except that the aqueous tack-prevention textile printing composition used in Example 3 was replaced by the above textile printing composition.

Continuous printing of 1000 fabrics was achieved using the multicolor rotating screen printing machine without any problems, as in the case of Example 3.

The quality of the cut-fabrics obtained was identical to that in Example 3.

EXAMPLE 9

<Preparation of Aqueous Tack-prevention Textile Printing Composition>

The following components were mixed to obtain 100 parts of a homogenous aqueous tack-prevention textile printing composition of white color: 30 parts of an emulsion containing 25% of saturated polyester resin having a Tg point of −26° C. (KZT-0507: UNITIKA LTD.), 10 parts of an emulsion containing 55% of ethylene vinyl acetate resin having a Tg point of 15° C. (PANFLEX 6500: KURARAY CO., LTD.), 17 parts of ethylene glycol, 3 parts of urea, 1 part of 20% sodium hexametaphosphate solution, 20 parts of titanium oxide (Titan R-650: ISHIHARA SANGYO Co., Ltd.), 1 part of a silicone antifoaming agent (Silicone KM-71: Shin-Etsu Chemical Co., Ltd.), 0.3 parts of ammonia water, 2 parts of a thickener (PRIMAL TT615: Rohm & Haas Japan K.K.), 13.7 parts of water, and 2 parts of an ethylene urea hardener (MATSUMIN FIXER F: Matsui Shikiso Chemical Co., Ltd.).

<Textile Printing Method Using Multicolor Rotating Screen Printing Machine>

Processes of textile printing, drying and heat treatment identical to those in Example 4 were performed, except that the aqueous tack-prevention textile printing composition used in Example 4 was replaced by the above textile printing composition.

Continuous printing of 1000 fabrics was achieved using the multicolor rotating screen printing machine without any problems, as in the case of Example 4.

The quality of the cut-fabrics obtained was identical to that in Example 4.

EXAMPLE 10

<Preparation of Aqueous Tack-prevention Textile Printing Composition>

The following components were mixed to obtain 100 parts of a homogenous aqueous tack-prevention textile printing composition of white color: 35 parts of an emulsion containing 25% of saturated polyester resin having a Tg point of −26° C. (KZT-0507: UNITIKA LTD.), 7 parts of a dispersion containing 40% of polyethylene resin (CHEMIPEARL W-200: Mitsui Petrochemical Industries, LTD), 17 parts of ethylene glycol, 3 parts of urea, 1 part of 20% sodium hexametaphosphate solution, 20 parts of titanium oxide (Titan R-650: ISHIHARA SANGYO Co., Ltd.), 1 part of a silicone antifoaming agent (Silicone KM-71: Shin-Etsu Chemical Co., Ltd.), 0.3 parts of ammonia water, 2 parts of a thickener (PRIMAL TT615: Rohm & and Chemicals, Incorporated).

As a result, after drying by the far-infrared dryer of No. 5 station, blocking of the textile printing composition printed in No. 4 station on the back of the screen of No. 6 station occurred, leading to lifting up of the T shirt from the stage, thus the textile printing process thereafter became impossible.

Here, strong tack developed on the printed surface after drying by the far-infrared dryer of No. 5 station.

Comparative Example 3

A textile printing process identical to that in Example 1 was performed, except that the amounts of the terpen as an oil and the silicone oil (Silicone SH200: Dow Corning Toray Silicone, Co., Ltd.) in the aqueous color textile printing composition used in Example 1 were reduced to 3 parts and 0.5 parts, respectively, while the total amount of reduction was replaced by water.

As a result, the textile printing composition adhered to the back of the screens in Nos. 7-9 stations, thus stable wet-on-wet continuous printing was impossible, and the textile printing compositions accumulated on the back of the screens as the number of printing increased, resulting in irregular printed surfaces.

Comparative Example 4

A textile printing process identical to that in Example 1 was performed, except that the nonionic surfactant having a cloud point of 40° C. (EMULGEN 108: Kao Corporation) used for emulsifying the oil in the aqueous color textile printing composition of Example 1 was replaced by a nonionic surfactant having a cloud point of 100° C. or higher (EMULGEN 930: Kao Corporation).

As a result, the textile printing composition adhered to the back of the screens in Nos. 7-9 stations although the degree of adhesion was not so severe compared to the comparative example 3, thus stable wet-on-wet continuous printing was impossible, and the binders accumulated on the back of the screens as the number of printing increased, resulting in irregular printed surfaces. Haas Japan K.K.), 11.7 parts of water, and 2 parts of an ethylene urea hardener (MATSUMIN FIXER F: Matsui Shikiso Chemical Co., Ltd.).

<Textile Printing Method Using Multicolor Rotating Screen Printing Machine>

Processes of textile printing, drying and heat treatment identical to those in Example 2 were performed, except that the aqueous tack-prevention textile printing composition used in Example 2 was replaced by the above textile printing composition.

Continuous printing of 1000 fabrics was achieved using the multicolor rotating screen printing machine without any problems, as in the case of Example 2.

The quality of the cut-fabrics obtained was identical to that in Example 2.

Comparative Example 1

A textile printing process identical to that in Example 1 was performed, except that the amount of the propylene glycol or ethylene glycol blended in the various types of aqueous textile printing compositions used in Example 1 was reduced to 3 parts, and the amount of urea was reduced to 0 part, while the total amount of reduction was replaced by water.

As a result, although printing could be performed without any problems immediately after the beginning, as the number of printed fabrics increased, clogging occurred in the screens and each printing composition thickened, and thin printed parts were observed at around 25 fabrics, then fairly significant clogging occurred at around 60 fabrics so that the screen must have been washed to obtain clear printed products.

Comparative Example 2

A textile printing process identical to that in Example 1 was performed, except that the emulsion containing 50% of saturated polyester having a Tg point of −26° C. (KZT-0507: UNITIKA LTD.) in the aqueous tack-prevention textile printing composition used in Example 1 was replaced by an emulsion containing 50% of acrylic resin having a Tg point of −20° C. (VONCOAT AB-781: Dainippon Ink

INDUSTRIAL APPLICABILITY

Since the textile printing compositions of the invention do not cause environmental problems and have superior printing characteristics, they are resistant to be used with multicolor rotating screen printing machines, and can provide products with superior characteristics.

What is claimed is:

1. An aqueous tack-prevention printing composition for multicolor rotating screen printing machines, wherein the composition comprises one or more resins from the group consisting of saturated polyester resin, polyamide resin, polyethylene resin, polyurethane resin, ethylene vinyl ester copolymer resin, silicone resin and acrylic silicone copolymer resin at a ratio of 5 to 35% by weight, which are tack prevention components and are used as a binder resin; multivalent alcohol at a ratio of 5 to 25% by weight; urea at a ratio of 1 to 10% by weight; inorganic porous material; white pigment; and hardener.

* * * * *